US007506679B2

(12) United States Patent
Yu et al.

(10) Patent No.: US 7,506,679 B2
(45) Date of Patent: Mar. 24, 2009

(54) FASTENER MODULE FOR A WINDOW COVERING AND METHOD

(75) Inventors: Fu-Lai Yu, Taipei Hsieh (TW); Chin-Tien Huang, Taipei Hsieh (TW); Shun-Chi Yu, Taipei Hsieh (TW)

(73) Assignee: Teh Yor Co., Ltd., Taipei (TW)

( * ) Notice: Subject to any disclaimer, the term of this patent is extended or adjusted under 35 U.S.C. 154(b) by 0 days.

(21) Appl. No.: 11/099,324

(22) Filed: Apr. 5, 2005

(65) Prior Publication Data

US 2006/0085957 A1 Apr. 27, 2006

Related U.S. Application Data

(63) Continuation-in-part of application No. 10/970,428, filed on Oct. 21, 2004.

(51) Int. Cl.
*E06B 9/388* (2006.01)
*E06B 9/28* (2006.01)
*A44B 21/00* (2006.01)

(52) U.S. Cl. ..... 160/178.3; 160/176.1 R; 24/318

(58) Field of Classification Search ..... 24/115 R, 24/129 R, 114.5; 160/84.01, 84.02, 84.03, 160/84.04, 84.05, 84.06, 176.1 R, 178.3; 248/229.1

See application file for complete search history.

(56) References Cited

U.S. PATENT DOCUMENTS

| | | | | | |
|---|---|---|---|---|---|
| 2,218,932 | A * | 10/1940 | Collins | 70/456 R |
| 3,239,900 | A * | 3/1966 | Bottoms | 24/115 R |
| 4,493,358 | A * | 1/1985 | Jacobson | 160/349.1 |
| 4,741,375 | A * | 5/1988 | Milford et al. | 160/84.06 |
| 4,765,037 | A * | 8/1988 | Perry | 24/301 |
| 5,088,609 | A * | 2/1992 | Fryc | 211/117 |
| 5,273,096 | A * | 12/1993 | Thomsen et al. | 160/84.01 |
| 5,566,735 | A * | 10/1996 | Jelic | 160/84.04 |
| 5,690,156 | A * | 11/1997 | Ruggles | 160/84.04 |
| 5,910,351 | A * | 6/1999 | Davis et al. | 428/100 |
| 6,257,300 | B1 * | 7/2001 | Brownlie | 160/84.01 |
| 6,402,110 | B1 * | 6/2002 | Berman et al. | 248/316.2 |
| 6,520,238 | B2 * | 2/2003 | Allsopp | 160/84.04 |
| 6,598,273 | B2 * | 7/2003 | Buettell | 24/316 |
| 6,792,994 | B2 * | 9/2004 | Lin | 160/84.03 |
| 6,854,500 | B2 * | 2/2005 | Chen et al. | 160/84.01 |

* cited by examiner

*Primary Examiner*—Robert J Sandy
(74) *Attorney, Agent, or Firm*—Olson & Cepuritis, Ltd.

(57) ABSTRACT

A fastener module suitable for use with a window covering having a plurality of openable rows is provided. More particularly, the fastener module enables engagement and disengagement of control cords from panels of a window covering.

30 Claims, 11 Drawing Sheets

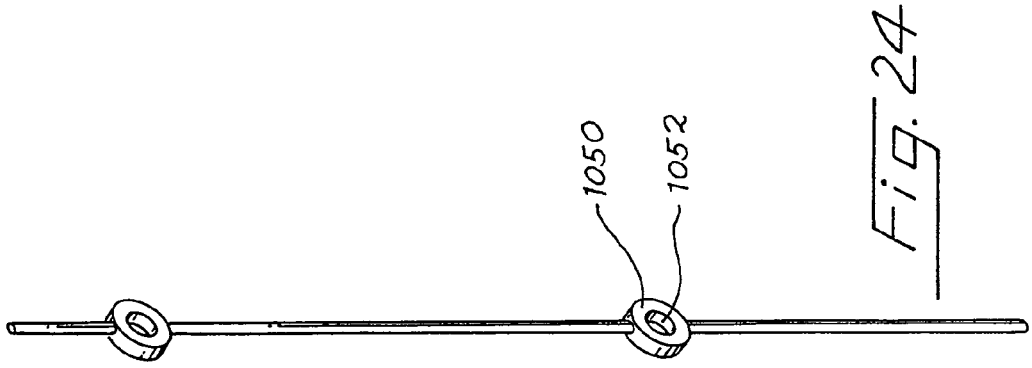
Fig. 24
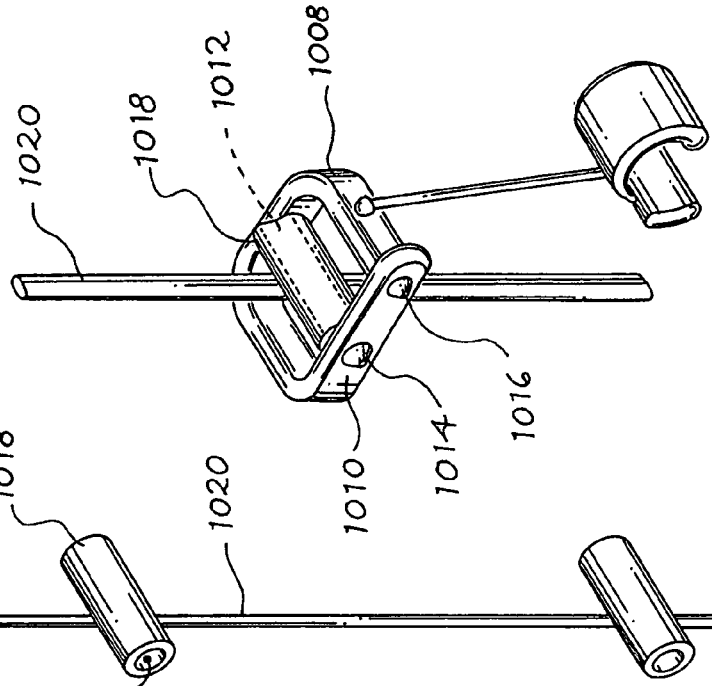
Fig. 23
Fig. 22
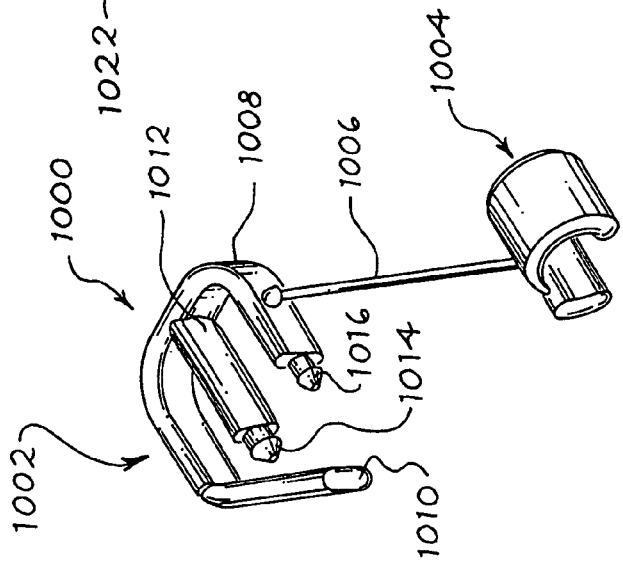
Fig. 21

FASTENER MODULE FOR A WINDOW COVERING AND METHOD

RELATED APPLICATIONS

The present application is a continuation-in-part of co-pending patent application Ser. No. 10/970,428 entitled Fastener Module for a Window Covering and Method, which was filed on Oct. 21, 2004, and is incorporated by reference.

TECHNICAL FIELD OF THE INVENTION

This invention relates to an improved fastener module for use with a window covering. More particularly, this invention relates to a fastener module and method for using the fastener module with a plurality of rows of panels of the window covering.

BACKGROUND OF THE INVENTION

Decorative window coverings are popular items for providing privacy and blocking light. These window coverings take on various forms, such as Roman shades, Venetian blinds, vertical blinds, honeycomb shades, and the like. Typically, window coverings include a panel or plurality of panels that cover an opening, which are connected to an adjustment mechanism with one or more control members.

For example, one popular type of window covering is known as a Roman shade. This type of shade consists of a fabric material attached along its top edge to a head rail and is gathered at spaced intervals to provide a series of soft folds across the face of the fabric. Consequently, the typical Roman shade has a cascaded or softly pleated appearance. Such Roman shades are constructed so that when they are raised, they gather from the bottom in generally horizontal folds or pleats until the entire shade resides near the top of the window covering. In some versions, the top of the window covering may also be lowered. The shades are operated by pulling on control members, which are attached to the shade. The control members are usually secured to a bottom portion of the panel with adhesive, ultrasonic welding, sewing, tying or the like. An alternative to the conventional Roman shade is disclosed in co-pending application Ser. No. 10/427,829. Unlike the standard Roman shade, the Roman style shade disclosed in co-pending application Ser. No. 10/427,829 enables the opening of the individual rows to create gaps in the face of the shade without requiring the entire shade to be raised. Co-pending application Ser. No. 10/427,829 is hereby incorporated by reference.

Another common type of window covering is a Venetian blind. Venetian blinds are typically constructed of a plurality of slats that are supported by a pair of ladders, which are controlled by an adjustment mechanism in a head rail. The ladder typically includes a pair of parallel cords suspended from the head rail and connected to a bottom rail. A number of rungs span across the parallel cords and support the slats. An alternative to the conventional Venetian blind is disclosed in co-pending application Ser. No. 10/413,200. Unlike the conventional Venetian blind, the blind disclosed in co-pending application Ser. No. 10/413,200 utilizes non-ladder control members and has a configuration that allows the slats to conceal the control members and holes for the control cords when the slats are closed. Co-pending application Ser. No. 10/413,200 is also hereby incorporated by reference.

With both Venetian blinds and Roman shades, the various control members are permanently secured to the light blocking elements. As such, there is a general lack of ability to releasably secure the light blocking elements from the control members. Even with the designs in the co-pending applications there is a lack of a releasable attachment mechanism which enables one to easily attach or release the control cords from the panels. Accordingly, there is no ability to easily select particular rows or portions of a window shade to be opened, while other portions remain closed. For example, when tilting the slats of a conventional Venetian blind, all of the slats must be opened or closed at the same time. Also, the removal of entire panels, such as for cleaning, is difficult, if not impossible. The inability to easily remove panels is especially troublesome with fabric-type window coverings which are not easily cleaned while installed.

The present invention overcomes these shortcomings by providing a fastener module that enables selectable and detachable engagement of the various rows of a window covering with the control members, and also permits entire panels of a window covering to be easily removed or interchanged.

SUMMARY OF THE INVENTION

The present invention relates to an improved fastener module for use in a window covering, such that the fastener module enables the portion of the window covering connected therewith to be disengaged from the fastener module. A window covering using the improved fastener module typically comprises a head rail and a plurality of rows suspended from the head rail.

The fastener module is preferably detachably secured to a longitudinal portion of a row of a window covering by way of the clip member, which is engaged with an anchor member, such as a longitudinal dowel or rod incorporated with the longitudinal portion of the row. Preferably, the clip member includes a pair of brackets that resiliently bend when urged over the anchor member and grasp the anchor member therebetween. The anchor member provides a stronger support for connecting the fastener module, panel and control members. Similar to the engagement member, the clip member may also take on a variety of forms, such as a tie, spring biased pin, or other mechanical means adapted for detachably securing the fastener module to the longitudinal portion of a row. The clip and buckle member are preferably unitary or integrally formed with one another.

Another embodiment of a fastener module of the present invention also includes a clip member and a buckle member, the buckle member further including a housing and an engagement member. In this embodiment, the clip member again is detachably secured with a longitudinal portion of a row. Rather than being secured to a control member, however, the buckle member is detachably secured with a head rail as is commonly found in window coverings. The buckle member may form a stirrup whereby the row to which the clip member is engaged is supported, held or fixed with the head rail.

One benefit of the fastener module is that it provides a user with the ability to easily choose which rows of a window covering to open or close. For example, a person may want to only open a number of the bottom rows, or every other row, or the rows of the top half of the window covering. With the fastener module of the present invention, this is possible. The window covering and fastener modules can also be provided in the form of a kit such that a user can customize which rows he or she wishes to be selectably operable. The following are examples of suitable window coverings to be used with the fastener module, but are not intended to be limiting.

In one embodiment which resembles a Roman-type shade such as shown in application Ser. No. 10/427,829 (which is incorporated by reference), each of the plurality of rows may be comprised of fabric material, such as a single continuous fabric panel or a plurality of fabric panels. Each of the plurality of rows defines a pair of opposed longitudinal regions. Adjacent rows preferably have little or no gap therebetween when the rows of the window covering are extended. Therefore substantially all light is blocked when the rows of panels are fully extended.

In this embodiment, at least one fastener module may be detachably secured to each of the rows of the window covering. The fastener module includes a clip securable to a first of the pair of longitudinal regions, and a buckle member securable with control members. The window covering further includes a first control member and a second control member. The first and second control members extend from the head rail behind the face of the window covering, and down the length of the window covering. Since there is little or no gap between the rows when they are extended, the control members and fastener modules behind the window covering face are hidden from view when the rows of the window covering are closed. The first and second control members are essentially interchangeable, however, for sake of explanation are denoted as such.

The first control member is selectably engageable with the buckle member of the fastener module for any desired row. When so engaged, the first control member is restrainedly positioned with the longitudinal portion of the selected row such that the longitudinal portion of the row can be raised or lowered by moving the first control member. The second control member is operatively connected to the longitudinal portion of the rows opposite that to which the first control member is connected. For example, if the first control member is connected to the bottom or lower longitudinal portion of the rows, then the second control member is connected to the top or upper longitudinal portion of the rows. If desired, the second control member may also be secured to the rows by way of a second fastener module. In so doing, a user can selectively engage either control member with either the upper or lower portion of a row. By raising or lowering the control cords, those row portions secured therewith are adjusted. By decreasing the distance between the upper and lower portions of a row, the row is narrowed to create gaps in the face of the window covering. Decreasing the distance can be achieved by individually raising or lowering the lower or upper portions respectively or moving the upper and lower portions simultaneously.

Through selective engagement of the fastener modules with the control members, a user can choose which rows of the window covering he or she wishes to open. For example, if one only desires to open the third and fourth rows of a window covering, he or she would only engage the fastener modules of those rows with a control member, such that when the control member is raised, it causes only the lower longitudinal row portions of the third and fourth rows to be narrowed. As such, only two openings are created in the window covering.

Another embodiment of a window shade with which the fastener module is suitable for use is described in application Ser. No. 10/413,200, which is also incorporated herein by reference. In this embodiment, a Venetian blind-type window covering comprises a head rail, bottom rail, and a plurality of rows. Each of the rows includes a slat having a distal portion and a proximal portion. The distal portion is substantially wider than the proximal portion such that when the window covering is in a closed position, the distal portion overlaps a lower adjacent row to conceal the adjustment and securement members. The various rows are tilted between closed and open positions by longitudinally raising or lowering the adjustment member relative to the securement member. Similar to the use of the Roman Style shade disclosed above, the fastening module can be utilized to selectively engage the adjustment member with only desired rows, such that only certain rows are opened or closed.

In addition to the benefit of the present invention of being able to selectively open particular rows of a window covering, entire individual panels may also be easily removed. As such, individual panels can be washed or replaced while the remainder of the window covering remains in place. For example, if a single panel is damaged or stained, rather than replace an entire window covering, a single panel can be replaced or cleaned. Also, different panels with a variety of colors, textures, light blocking characteristics, etc. can interchanged with the existing panels. As such, one can change the color of a window covering without having to buy an entirely new window covering. Instead, one could exchange some or all of the existing panels with different panels.

In an alternate embodiment of the present invention, the fastener module may include an arm member connecting the buckle member and the clip member. The arm member is preferably flexible so as to provide some degree of freedom of movement between the buckle member and the clip member. This relative freedom of movement allows a smoother manipulation of the control cord to drive raising or lowering of the shade row. This movement tolerance reduces negative effects caused by swaying or movement of the shade rows, such as inadvertent disengagement.

BRIEF DESCRIPTION OF THE DRAWINGS

In the drawings,

FIG. 21 is an enlarged perspective view of an alternative fastener module having an arm member;

FIG. 22 is a perspective view of a plurality of braces secured with a control cord;

FIG. 23 is an enlarged perspective view of the fastener module of FIG. 21 engaged with a brace of FIG. 22;

FIG. 24 is a perspective view of an alternate embodiment of a plurality of braces secured with a control cord and suitable for engagement with a fastener module;

DESCRIPTION OF THE PREFERRED EMBODIMENTS OF THE INVENTION

Figure 2:
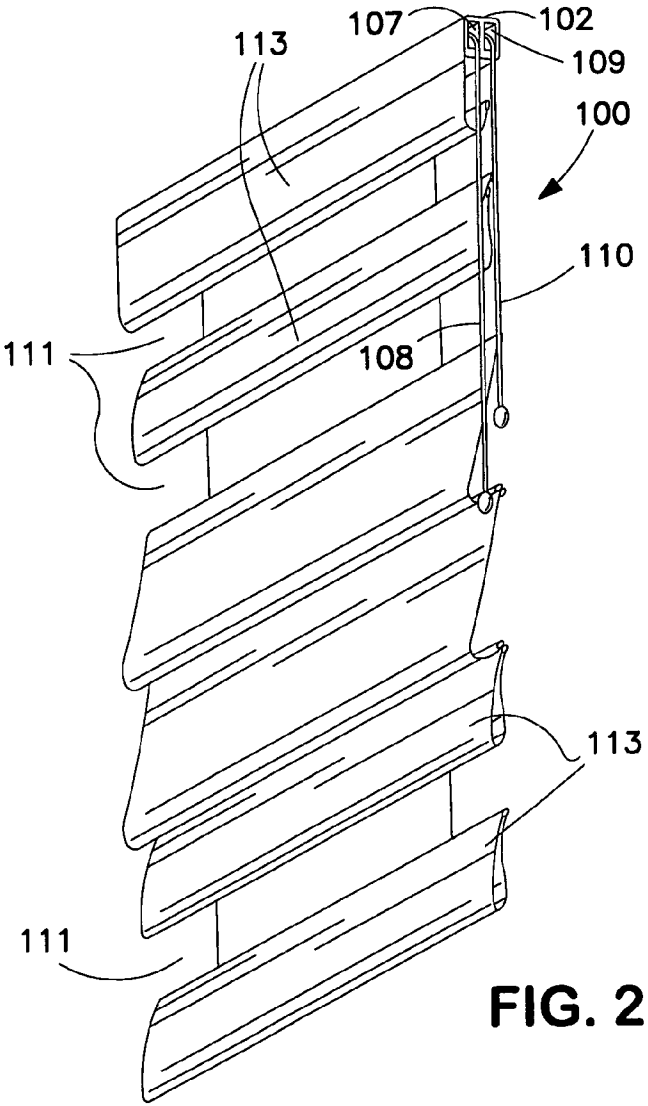
FIG. 2 is a perspective front view of the window covering of FIG. 1 in a partially open position.

The invention disclosed herein is susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Figure 1:
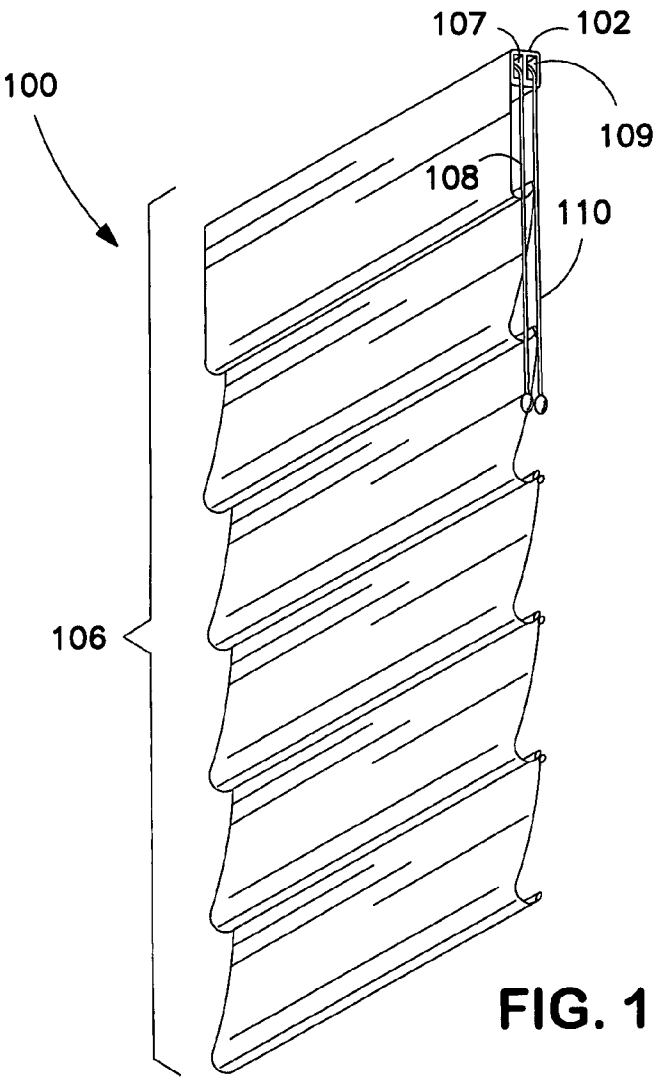
FIG. 1 is a perspective front view of an embodiment of a window covering with which the fastener module of the present invention is suitable for use.

An embodiment of a window covering with which the fastener module of the present invention may be used is shown in FIG. 1. Window shade 100 is shown in a closed position, and includes a head rail 102 and a plurality of rows 106. Also preferably provided is a first control member, such as an opening cord 108, for narrowing the profile of selected individual rows and thereby creating gaps or openings in the overall face of window shade 100, as well as a raising cord 110 for raising the entire shade 100. First control member 108 and raising cord 110 are passed through vertical adjustment mechanisms, such as cord locks 107 and 109, respectively.

In a fully closed state as shown in FIG. 1, the window shade 100 offers an appearance free of connecting cords and provides both privacy and light blocking. If it is desired to allow light into a room without raising the entire shade, and thereby retaining a degree of privacy, a user actuates a first control member, such as by pulling and retracting a cord 108 such that the portion of cord 108 extending behind the rows 106 is raised and selected rows 113 (FIG. 2) are adjusted to narrow their profile by drawing a lower portion of these rows behind the face of the selected row and thereby forming gaps 111.

Figure 4:
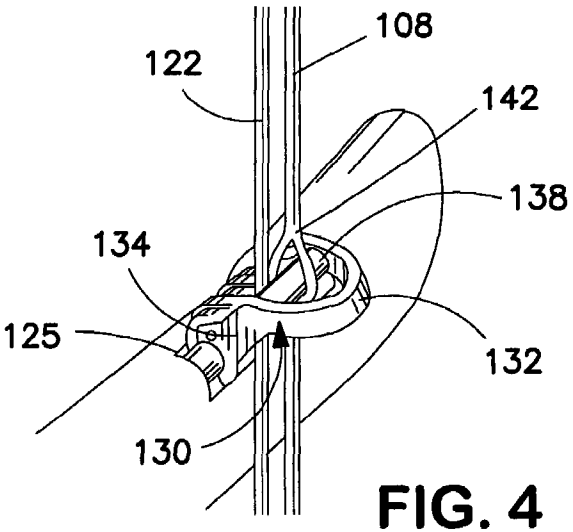
FIG. 4 is an enlarged view of the fastener module of FIG. 3.
Figure 5:
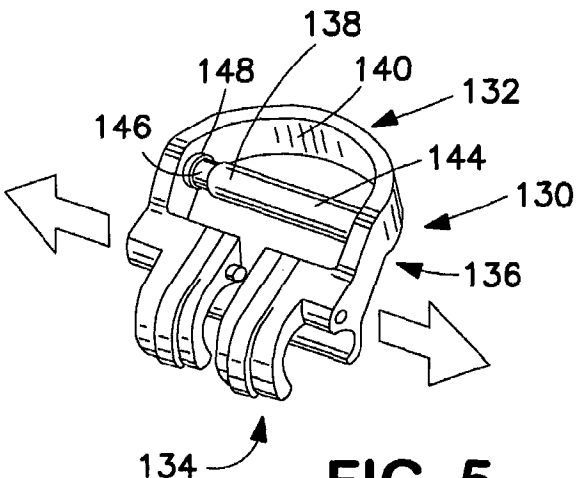
FIG. 5 is an enlarged perspective view of the fastener module of FIG. 4 with the tab member disengaged from the transverse rod.
Figure 3:
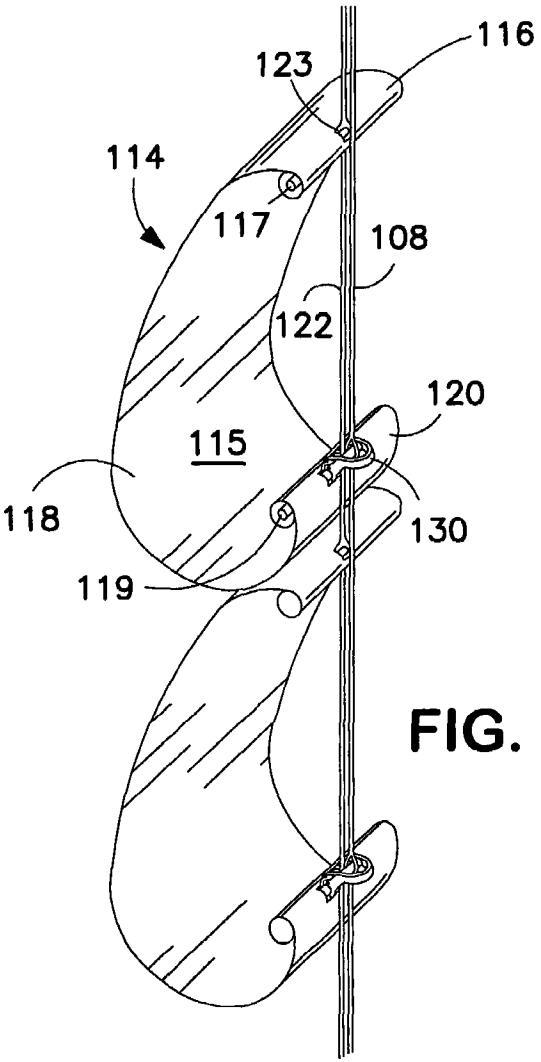
FIG. 3 is a perspective rear view of rows from the window covering of FIG. 1 showing an embodiment of the fastener module of the present invention.

The fastener module of the present invention is shown in use with the example row 114 of window covering 100 in FIGS. 3 and 4 and also with respect to FIG. 5. Row 114 is preferably formed of a single panel 115 of fabric material having an upper longitudinally extending region 116, a central longitudinally extending region 118, and a lower longitudinally extending region 120. It is preferred that anchor members, such as longitudinal dowels 117 and 119 are incorporated into the upper region 116 and the lower region 120 of the row 114. Preferably, the anchor members extend across the width of the rows to provide even and strong support for the fabric material.

Positioned at the lower region 120 of row 114 is fastener module 130, which is described in greater detail with respect to FIGS. 4 and 5. Fastener module 130 includes a buckle 132 and a clip 134, and is preferably made of a resilient material, such as a thermoplastic resin, lightweight metal, or the like. An opening, such as notch 125, is formed in the lower region 120 to expose a portion of dowel 119, so that the fastener module 130 may be engaged therewith. In particular, clip 134 is securable to dowel 119 by way of frictional engagement or by a mechanical force applied by the clip 134 on the dowel 119, such as exerted by the resilient properties of the material making up the clip 134. In other embodiment, the clip member may be secured or restrainedly positioned with the anchor member by encircling or looping around the anchor member.

In this embodiment, buckle 132 includes a housing 136 and an engagement member, such as transverse rod 138. Transverse rod 138 includes a first end 144, which is secured to or integral with the housing 136, and a second end 146, which is engageable with tab member 140 by urging second end 146 through hole 148. In this embodiment, tab 140 is an arcuate member integrally formed as part of housing 136 and defining a hole 148.

The tab member may take on other forms. For example, it may be a portion of the housing that is in a hinged relationship with the housing to allow the tab to be pivoted into or out of engagement with the transverse rod. A tab member may, in some embodiments, not be necessary. For example, the second end 146 of the transverse rod 138 can be of sufficient size and shape so that cord 108 can not easily disengage itself from the transverse rod 138. For example, since cord 108 is preferably made of a somewhat stretchable resilient material like cotton, polyester, or the like, the relative size of the second end 146 to the hole 142 can be such that to disengage cord 108 from the fastener member 130, the cord 108 must be urged past the second end 146.

First control member cord 108 is engaged with fastener module 130 by way of transverse rod 138, which is passed through hole 142 defined by cord 108. Second control member cord 122 is passed through fastener module 130, but is not secured thereto. As such, as cord 108 is retracted or raised, the lower region 120 is also retracted or raised such that an opening is formed in the window covering. Also, since cord 122 is passed through housing 136 and is free to move in a vertical direction relative thereto, the fastener module 130, and in particular the housing 136 act as a guide for cord 122. In this embodiment, second control member 122 is secured to the anchor member 117 by passing the anchor member 117 through a hole or loop 123 formed in control member 122.

Figure 6:
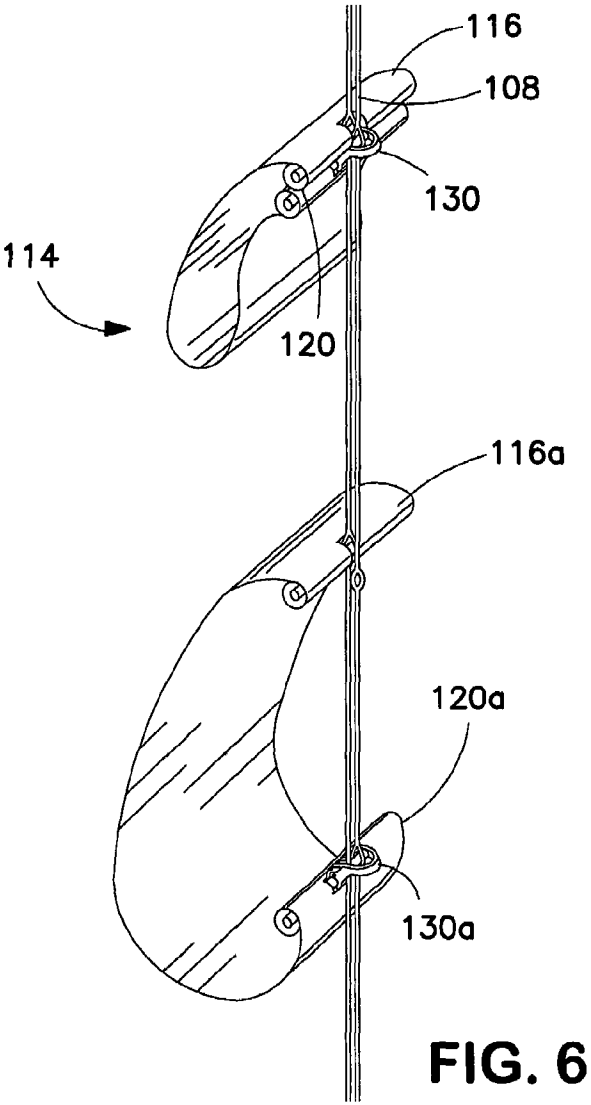
FIG. 6 is a perspective rear view of FIG. 3 showing the selective engagement of the fastener module.

Referring to FIG. 6, by engaging fastener module 130 with the first control member cord 108, as discussed above, the lower region 120 is raised relative to the upper region 116 as cord 108 is retracted, thereby narrowing the profile of the row 114 and creating an opening in the window covering. As shown, first control member cord 108 is not engaged with fastener module 130*a*. Thus, as cord 108 is retracted, lower region 120*a* is not raised relative to the upper region 116*a* and the row is not narrowed. Since each of the rows in the window covering have such a fastening module, a user can selectively engage or disengage the various fastener modules such that only desired rows are opened as the first control cord is retracted as shown in FIG. 2.

The vertical adjustment mechanisms utilized to control the raising and lowering of the various control members, as well as a raising cord, may be any suitable mechanism known in the art. For example, the vertical adjustment mechanism may be similar to the mechanism commonly found in Venetian blind systems for adjusting the position of cords, such as a worm gear assembly fitted within the head rail and manipulable by an operatively connected wand. Alternatively, a cord lock assembly can also be utilized with the opening member to control the raising and lowering of the control members. As yet another alternative, a power driven or remotely controlled vertical adjustment mechanism can also be utilized to retract or extend the control members.

In this embodiment, the first control member cord 108 is described as being selectively engaged with fastener module 130, which is positioned at the lower longitudinal region 120 of a row. However, the fastener module could be positioned at the upper longitudinal region and the profile of the row narrowed by lowering the upper region relative to the lower region.

Figure 7:
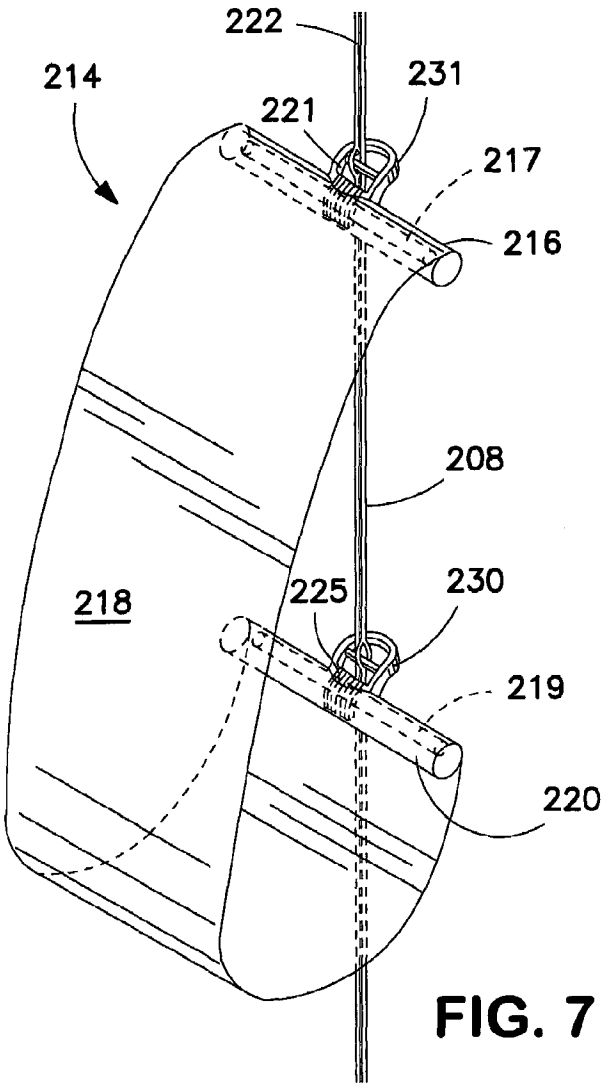
FIG. 7 is a perspective side view of an alternate embodiment of a row of a window covering showing embodiments of fastener modules according to the present invention secured to both longitudinal portions of the row.

A further benefit of the fastener module of the present invention is explained with reference to FIG. 7. In this embodiment, a window covering is again comprised of several rows of panels, such as row 214. In this embodiment, a second fastener module 231 is engaged with the second control member, such as cord 222. Similar to the previous embodiment, row 214 includes an upper longitudinally extending region 216, a central longitudinally extending region 218, and a lower longitudinally extending region 220, with anchor members, such as dowels 217 and 219, incorporated with upper region 216 and the lower region 220, respectively. An opening, such as notch 221, is formed in the upper region 216 to expose a portion of the dowel 217, so that a fastener module 231 can be engaged therewith. A similar opening, such as notch 225, is formed in the lower region 220 to expose a portion of dowel 219, so that fastener module 230 may be engaged therewith.

In this embodiment, both the first and second control members, such as cords 208 and 222, respectively, are adjustable with one or more vertical adjustment mechanisms in the head rail as is known in the art (not shown), such as cord locks, rotatable drums, and the like. As such, either second control member cord 222 can be lowered, thereby lowering upper region 216 to lower region 220, or first control member cord 208 can be raised, thereby raising lower region 220 to upper region 216, or a combination of both, to create openings in the window covering. In other words, the narrowing of a row may be affected by individually raising or lowering the first control member, the second control member, or a combination of both.

In addition, as discussed above, fastener module 231 and fastener module 230 may each be disengaged from dowels 217 and 219, respectively, such that panel 218 can be completely removed from the window covering. The dowels 217 and 219 can be removed and the fabric panel 218 washed or replaced as desired. Therefore, rather than remove an entire window covering from the mounting brackets typically used to secure a window covering to a window frame, individual panels are easily removed. Installation of a panel is also easily accomplished by securing the fastener module with the anchor members. Since the fastener modules 230 and 231 are left in the correct positions on control members 108 and 122, the panel is easily re-installed, or a new panel installed, at the correct positions on the control members 108 and 122.

Figure 8:
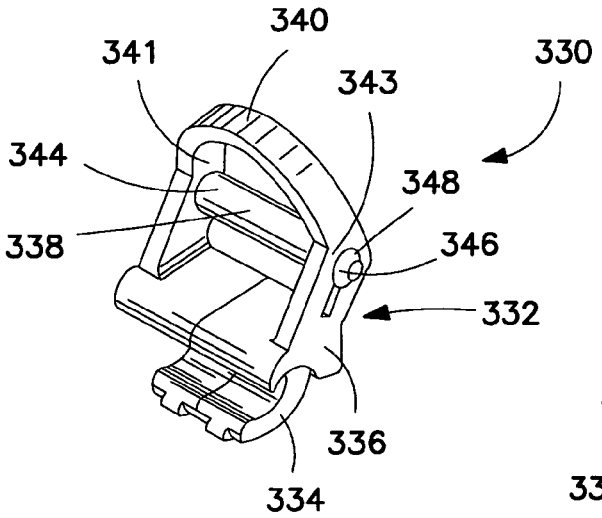
FIG. 8 is a perspective view of an alternate embodiment of a fastener module.
Figure 9:
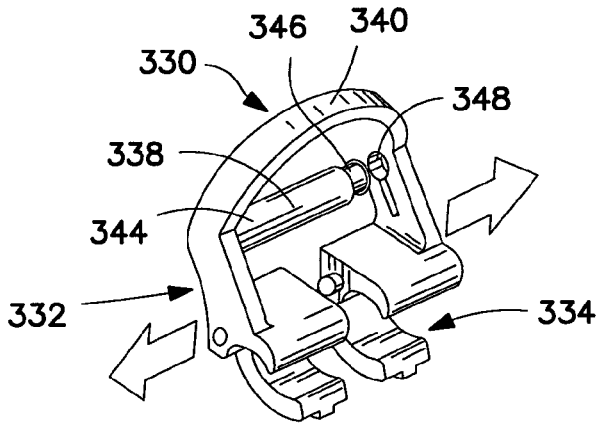
FIG. 9 is a perspective view of the fastener module of FIG. 8 in an open position.

A variation of the fastener module of FIGS. 4 and 5 is provided in FIGS. 8 and 9. Similar to the fastener module of FIGS. 4 and 5, fastener module 330 includes a buckle 332 having a housing 336 and an engagement member, such as transverse rod 338, with a first end 344 and a second end 346. Buckle 332 further includes an arcuate portion 340 defining a first end 341 and second end 343. Second end 343 defines a hole 348 through which the second end 346 of the transverse rod 338 may be passed to engage the second end 346 with the arcuate portion 340. The fastener module 330 is shown in a disengaged or open state in FIG. 9. Fastener module 330 further includes a clip member 334 for detachably securing to a longitudinal portion of a panel of a window covering. In this embodiment, the spacing between the transverse rod 338 and the clip member 334 is somewhat greater than the previous embodiment to create a larger opening through which control members of a window covering are guided.

Figure 10:
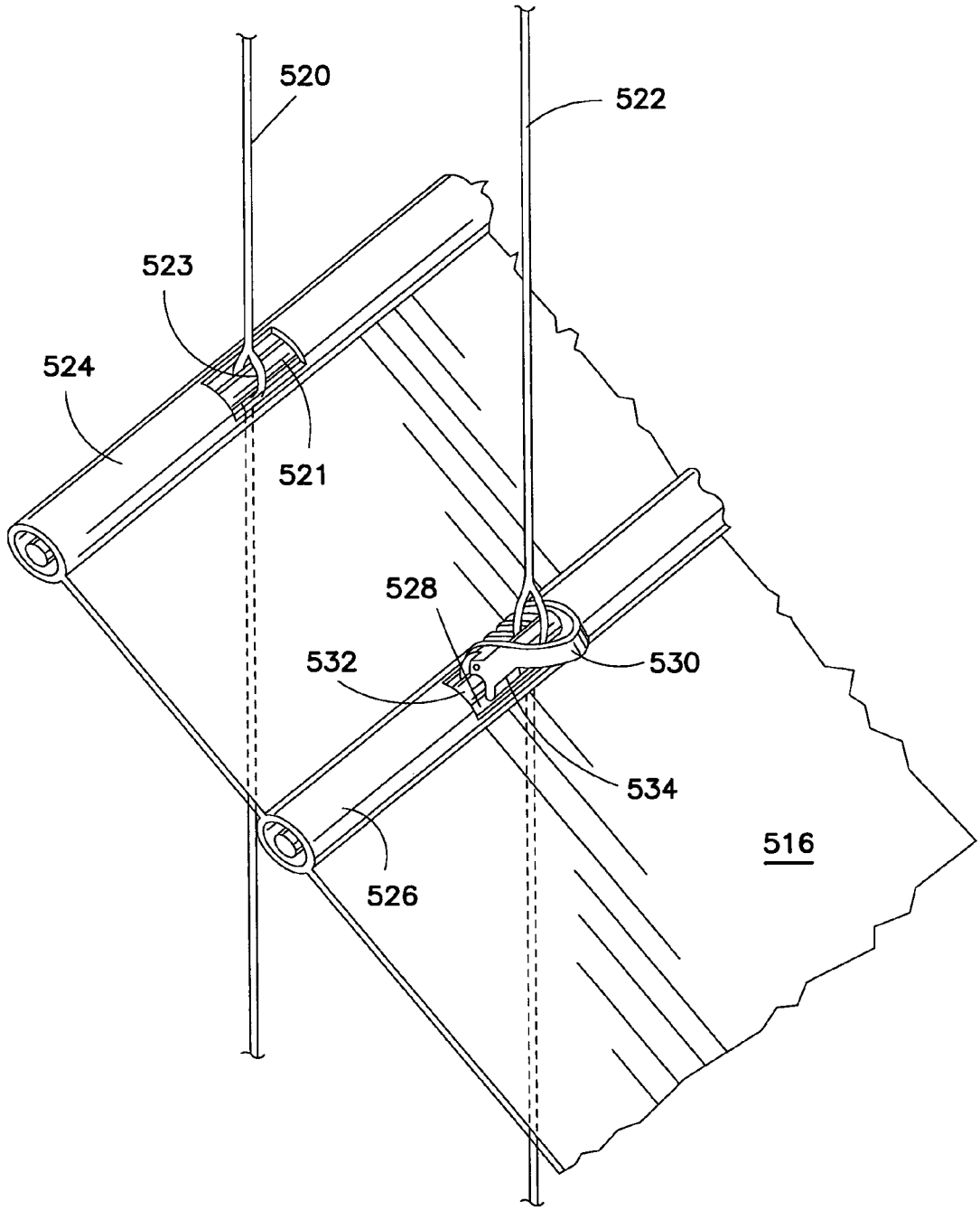
FIG. 10 is a partial schematic perspective view of a row from an alternate window covering utilizing a fastener module.

Thus far, the fastener module has been described in use with a Roman shade-type window covering. Referring to FIG. 10, an alternate window covering utilizing the fastener module is shown. In this embodiment, a row from a Venetian-type blind such as shown in application Ser. No. 10/413,200 is shown.

In this embodiment, securement member 520 and adjustment member 522 are used to tilt and open slat 516. Securement member 520 is secured to a first longitudinal portion 524 of the slat 516 and adjustment member 522 is secured to a second longitudinal portion 526 of the slat 516, which is located distally of the first longitudinal portion 524. In this particular example, a fastener module 530 is used to secure the adjustment member 522 (a portion of which is shown in phantom) to its anchor member 528 positioned with longitudinal portion 526. It should be understood that, similar to the previous window shade example, a fastener module can be used at any point that a control cord is secured to a row of a window covering. An opening, such as notch 532, is also formed in the fabric to enable the clip member 534 of fastener member 530 to engage with rod 528. Anchor member 521 is positioned with longitudinal portion 524 and is restrainedly positioned with cord 520 by way of loop 523 formed therewith.

By selectively engaging the fastener module 530 to an anchor member, such as rod 528, a slat may be tilted by longitudinal movement of the adjustment member 522. If the fastener module 530 is not engaged with the anchor member 528, longitudinal movement of the adjustment member 522 will not cause the particular slat to tilt. Accordingly, a user can choose to have only selected rows of slats open or close. In this particular embodiment, only one fastener module 530 is shown, however, as discussed above, a second fastener module could be utilized rather than connecting the cord 530 with anchor member 521.

Figure 11:
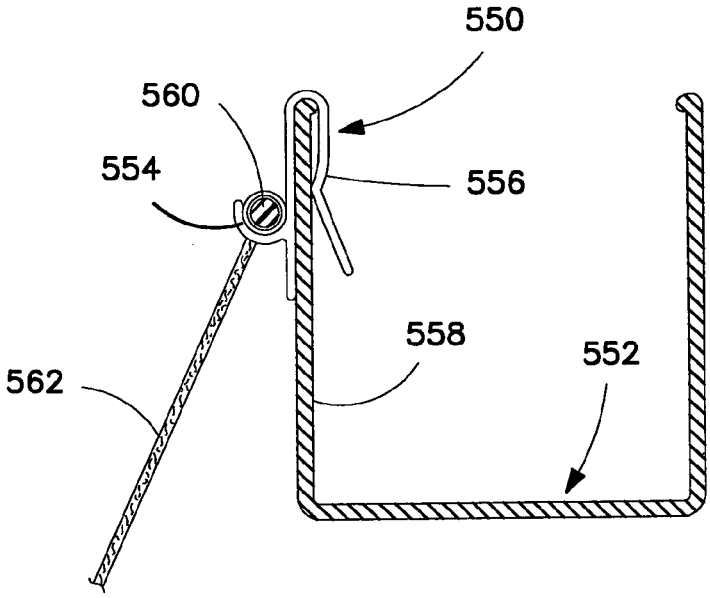
FIG. 11 is an enlarged partial side elevated view of another alternate embodiment of the fastener module removably securable with a head rail, the head rail and panel being shown in cross-section.

The fastener module of the present invention may also take on another form. Shown in FIG. 11 is fastener module 550 removably secured to head rail 552. Fastener module includes a clip member 554 and a buckle member 556. In this embodiment, clip member 554 and buckle member are integrally formed with one another. Buckle member 556 substantially forms an inverted U-shaped or stirrup-shaped member which is fit over the rail 558 of a head rail 552. Preferably, the buckle member 556 grasps rail 558 such that the fastener module 550 is frictionally engaged therewith. The clip member 554 is similar to the previous clip members described. Clip member 554 is an arcuate member that is configured to grasp the anchor member 560 of the topmost panel 562 of a window covering (shown in phantom). As discussed above, the panels are thereby detachable from the other components of the window covering in order to allow entire panels to be removed, such as for cleaning or replacement.

Figure 12:
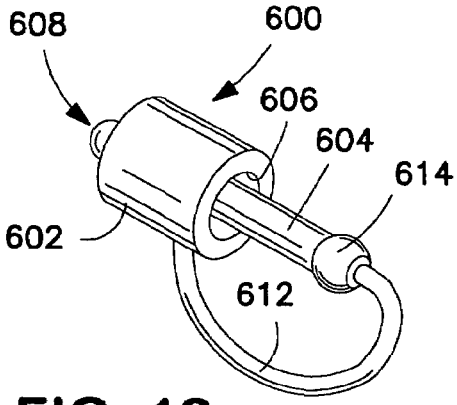
FIG. 12 is a perspective view of an alternate embodiment of a fastener module according to the present invention.
Figure 13:
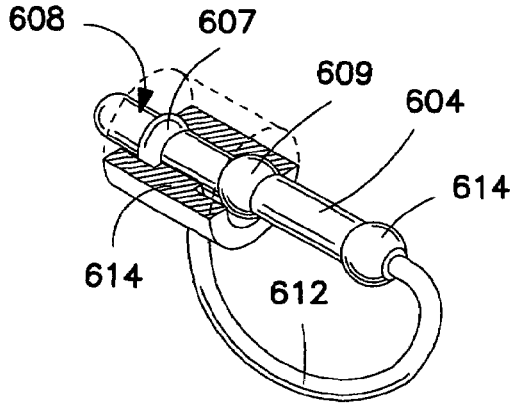
FIG. 13 is a perspective view of the fastener module of FIG. 12 with the holster shown partially cut away.
Figure 14:
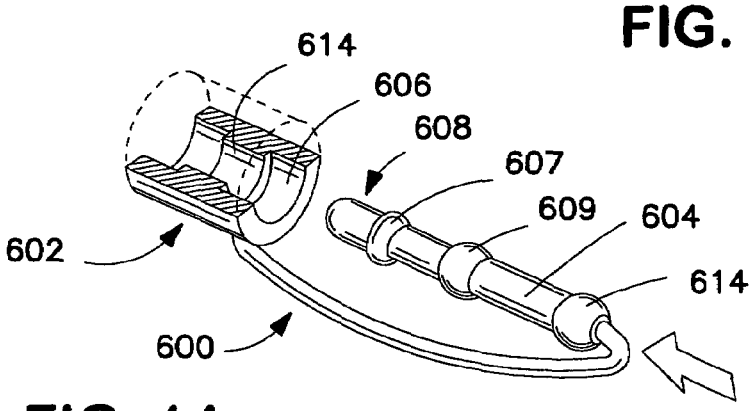
FIG. 14 is a perspective view of the fastener module of FIG. 12 with the holster shown partially cut away and the transverse rod disengaged from the holster.

Yet another alternate embodiment of a fastener module according to the present invention is depicted in FIGS. 12-14. In this embodiment, the fastener module 600 includes a holster 602, a buckle member, such as transverse rod 604, which is insertable into a passageway 606 defined by the holster 602. The transverse rod 604 includes a distal end portion 608 having a detent that engages a catch 614 within passageway 606. In this embodiment, the detent comprises a pair of raised sections 607 and 609 on the distal end portion 608, which are resiliently deformable, and the catch is an offset portion of the passageway. The distal raised section 607 is deformed and urged past catch 614. The proximal raised section 609 limits the extent to which the transverse rod 604 enters passageway 606. Transverse rod 604 is disengaged from holster 602 by exerting force on the distal end portion 608 to urge the distal raised section 607 past catch 614.

Figure 15:
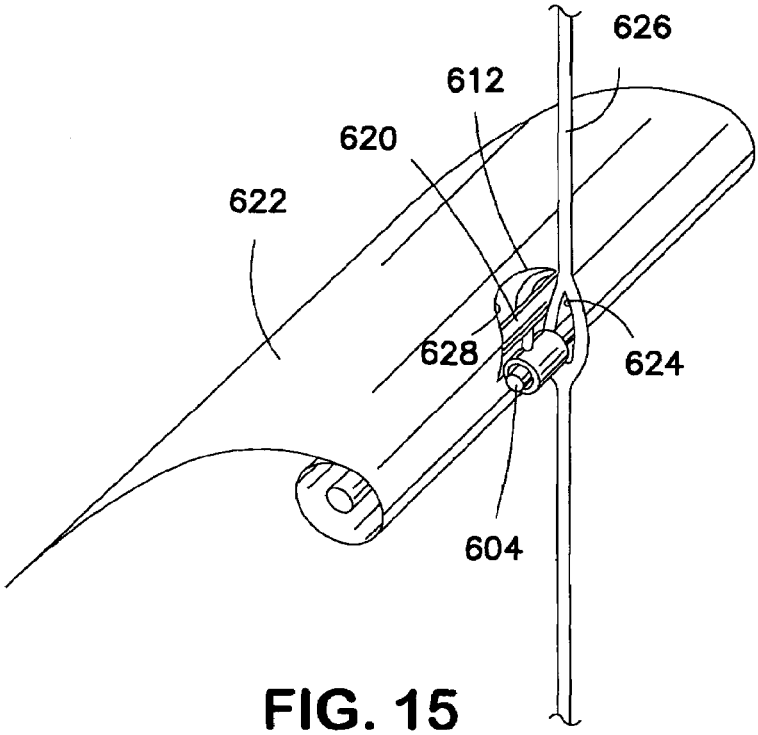
FIG. 15 is an enlarged perspective view the fastener module of FIG. 12 engaged with a panel and control cord of a window covering.

A clip member, such as flexible band 612 connects holster 602 to transverse rod 604 at a proximal end 614 opposite the distal end portion 608. The flexible band 612 also serves to restrainedly position the fastener module 600 with an anchor member 620 of a panel 622 of a window covering, such as shown in FIG. 15. Transverse rod 604 is guided through loop 624 formed in control cord 626. Proximal end 614 further defines a bulbous portion designed to limit the movement of the control cord 626. The band 612 is guided through opening 628 in the panel 622 and around anchor member 620 such that the fastener module 600 and control cord 626 are restrainedly positioned therewith.

Figure 16:
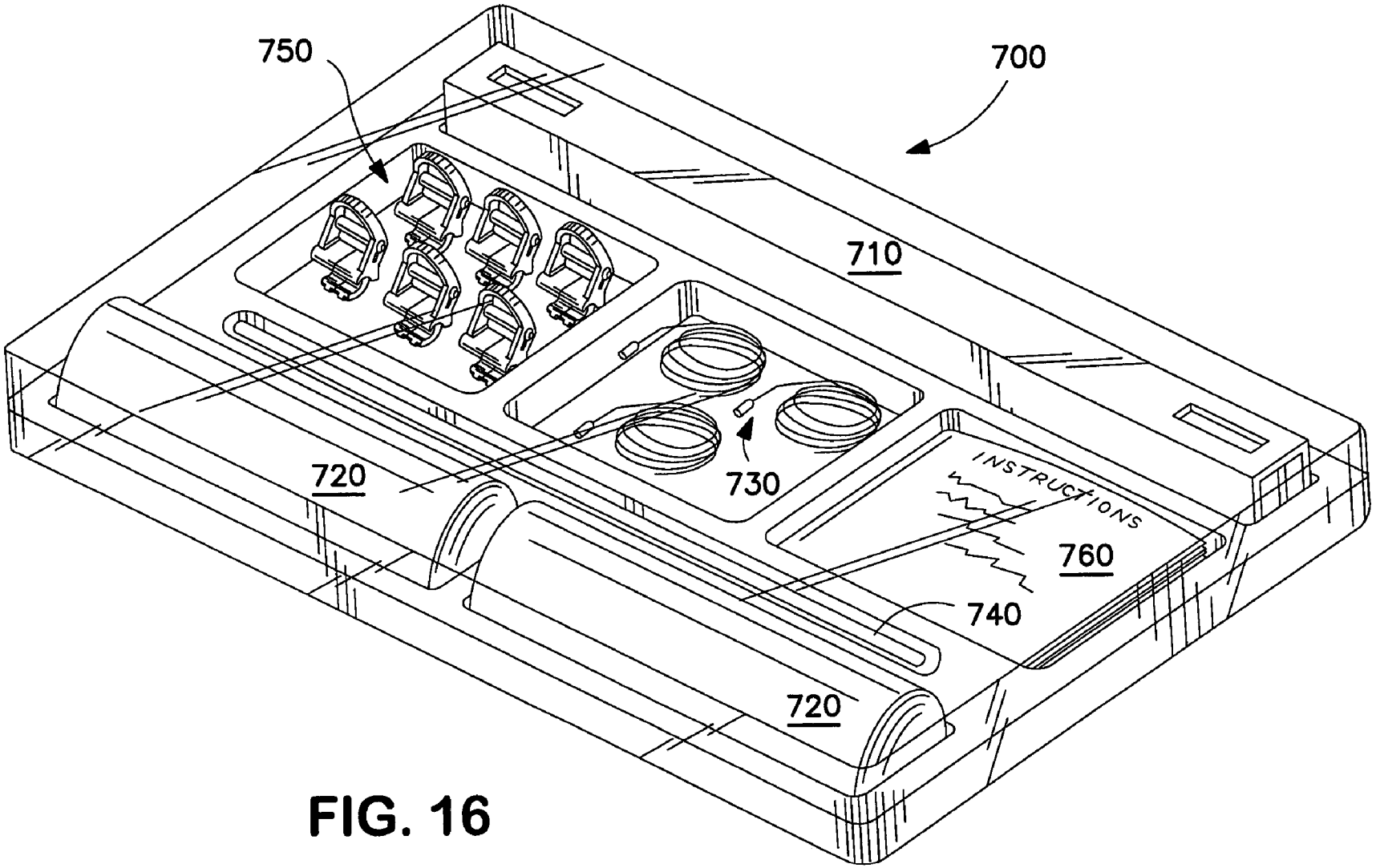
FIG. 16 is a schematic perspective view of a kit according to an embodiment of the present invention.

The present invention has also been discussed in terms of a completed window covering. It should be noted that the window covering can be sold in a disassembled form, such as in a kit 700 (FIG. 16), so that a user can assemble the window covering by himself or herself The kit 700 may include such items as a head rail 710, fabric panels 720, control cords 730, anchor members 740, and a plurality of fastener modules 750. Instructional materials 760 may also be included.

Figures 17, 18, 19, 20:
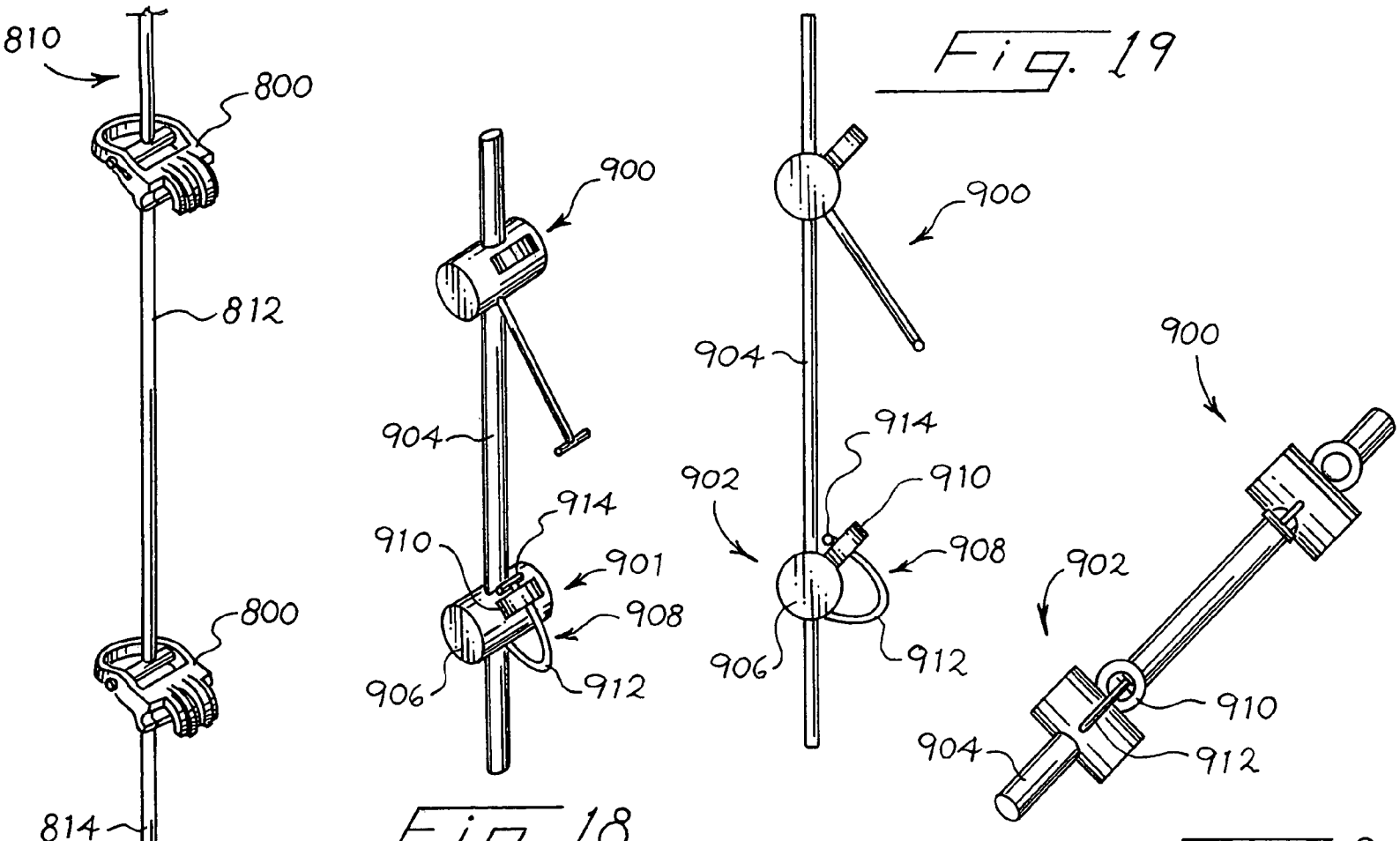
FIG. 17 is an enlarged perspective view of an alternative fastener module fixedly secured to a control cord.
FIG. 18 is an perspective view of another alternative fastener module fixedly secured to a control cord.
FIG. 19 is a side elevated view of the fastener module of FIG. 18.
FIG. 20 is a front elevated view of the fastener module of FIG. 18.

In the embodiments discussed thus far, the fastener module is generally detachable from the control member. Alternatively, fastener modules may be integral with the control member. Shown in FIG. 17 is a control cord 810 having a plurality of fastener modules 800 secured therewith. Fastener modules 800 are integral with the control cord 810. Control cord 810 includes a plurality of segments, such as cord segments 812 and 814. These segments 812 and 814 are secured with control cord 810, such as by welding. Alternatively, control cord 810 may be a continuous cord to which the fastener modules 800 are fixedly secured, such as by welding, adhesive or the like. In addition, the buckle member can alternatively by integrally fixed to the cord by injection molding the buckle member over the cord.

Yet another embodiment of a suitable fastener module is shown in FIGS. 18-20. Fastener modules 900 and 902 are secured to control cord 904. Fastener module 902 includes a buckle member 906 and a clip member 908. Buckle member is secured directly with control cord 904, and includes an eyelet 910. Clip member 908 includes a resilient band 912 having a detent 914. Band 912 is guided around an anchor member (not shown) of a row of a window panel, such as discussed above. Detent 914 is guided through eyelet 910 and secured therewith. In this example, fastener modules 900 and 902 are fixedly secured with control cord 904, such as by welding or gluing.

An additional feature of the present invention is an arm member positioned between the buckle member and the clip member that provides for movement tolerance between the buckle member and the clip member.

One example of such a feature is shown in FIG. 21. Fastener module 1000 includes a buckle member 1002 and a clip member 1004 which connects to an anchor member similar to that shown in FIG. 4. Arm member 1006, which is integral with the buckle member 1002 and clip member 1004, is positioned between the buckle member 1002 and the clip member 1004. Buckle member 1002 includes a housing 1008, a tab member 1010 and an engagement member, such as transverse rod 1012. Transverse rod 1012 may be guided through a loop formed with a control cord, such as discussed above. Tab member 1010 is secured with a distal end 1014 of transverse rod and a distal end 1016 of housing 1008 by guiding distal ends 1014 and 1016 through recesses or holes (not shown) in the tab member 1010. Arm member 1006 accommodates minor shifts in position between the window covering rows to which the clip member is secured and the control cord to which the buckle member is secured. This relative freedom of movement allows a smoother manipulation of the control cord to drive raising or lowering of the shade row. Without this movement tolerance, the manipulation of the control cord can be negatively affected by swaying or other movement from the shade rows, such as by unintentional disengagement of the fastener module from either the window rows or the control members. Such movement tolerances are suitable to accommodate minor relative positional shifts between the control member and the rows of the window covering. Typically such minor shifts are only of about 0.5 to 1.0 centimeters, but can be configured as desired if greater amounts of shifting are anticipated.

For example, the arm member 1006 permits multiple degrees of freedom of movement to provide multidimensional movement tolerance, such as to accommodate pivotal and lateral movement, between the clip member 1004 and the buckle member 1002 when the respective components are secured to the window covering and control cords. By allowing for some flexibility between the positions of the buckle member and the clip member relative to one another, unintended disengagements are decreased.

An alternative to securing the transverse rod 1012 with a loop formed in the cord is shown in FIGS. 22 and 23. Shown in FIG. 22 are a plurality of braces, such as brace 1018, which is fixedly secured with control cord 1020, such as by welding or adhesion. Brace 1018 defines a passageway 1022 adapted to accept transverse rod 1012 (FIG. 21) therein. Referring to FIG. 23, the transverse rod 1012 (shown in phantom) is guided through passageway 1022 of brace 1018, and distal end 1014 secured with tab member 1010. In order to provide additional securement, tab member 1010 is also secured with distal end 1016 of housing 1008. An alternative brace suitable for engagement with a transverse rod is depicted in FIG. 24. Brace 1050 comprises an annular member defining a hole 1052. Transverse rod 1012 of fastener module 1000 may be guided through hole 1052 and secured therewith as discussed above. In this embodiment, only a single degree of freedom of movement, namely pivotal, is provided by the arm member 1106.

Figures 25, 26, 27, 28:
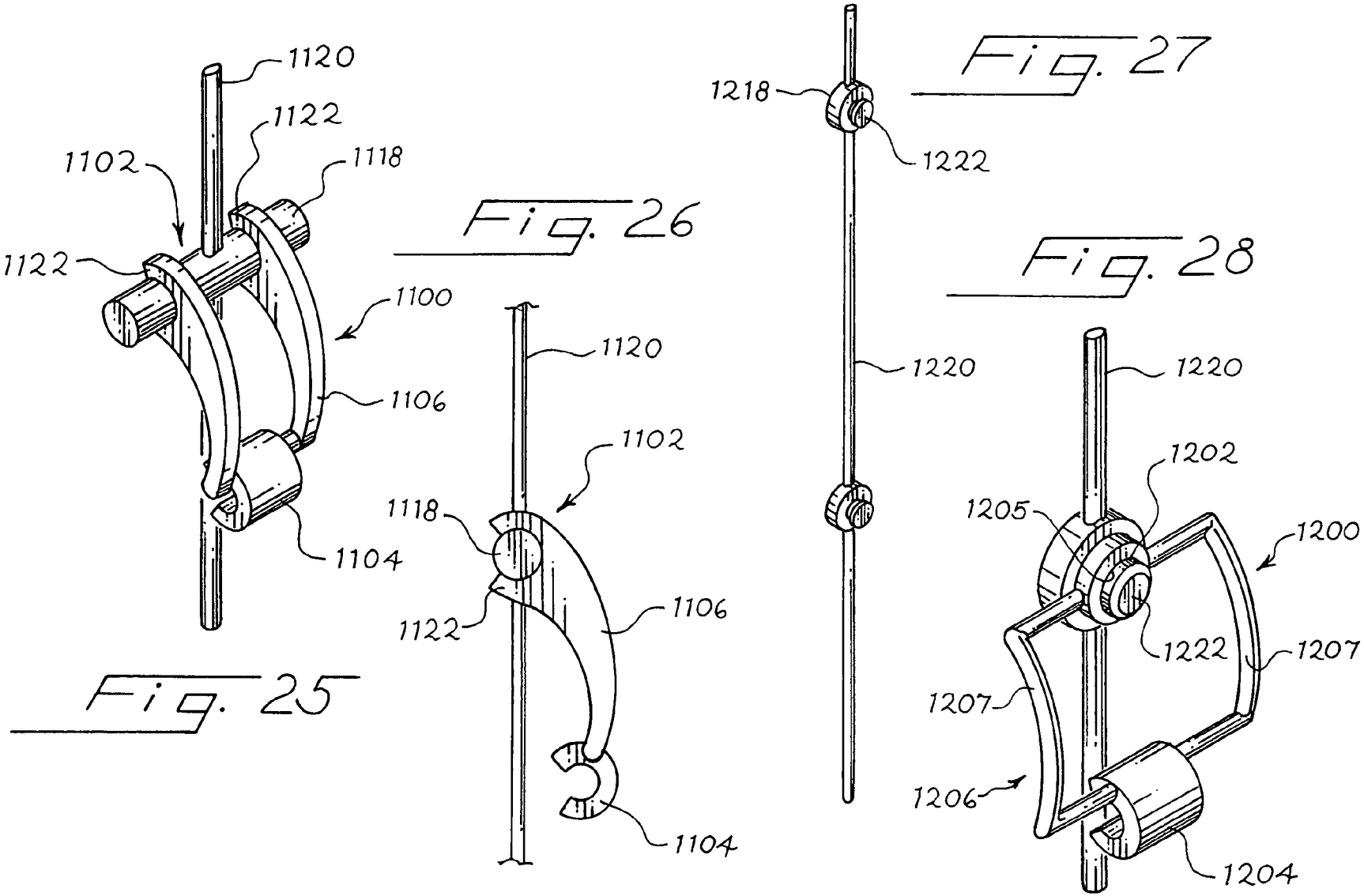
FIG. 25 is an enlarged perspective view of another alternate embodiment of a fastener module secured with an alternative brace.
FIG. 26 is a side elevated view of the fastener module of FIG. 25.
FIG. 27 is a perspective view of another alternate embodiment of a plurality of braces having a peg secured with a control cord and suitable for engagement with a fastener module.
FIG. 28 is an enlarged perspective view of an alternative fastener module engaged with the brace of FIG. 27.

Another embodiment of the present invention is shown in FIGS. 25 and 26. Fastener module 1100 includes a buckle member 1102 and a clip member 1104. Arm member 1106, which is unitary with the buckle member 1102, connects to clip member 1104 and provides movement tolerance between the buckle member 1102 and the clip member 1104. In this embodiment, the arm member 1106 includes a pair of arm member, and defines a vertical spacing between the buckle member 1102 and the clip member 1104, which is secured to an anchor member (see e.g., FIG. 3 anchor member 119). This vertical spacing further facilitates the overlapping of adjacent rows of the window covering for more complete light blockage. The vertical spacing is greater than the width of at least one of the arm members 1106. In this embodiment the fastener module 1100 is secured with the control cord 1120 by way of a brace, such as rod 1118 fixedly secured to the control cord 1120. Buckle member 1102 includes a pair of brackets 1122 that secure with rod 1118 by urging rod 1118 within arcuate latch 1124.

Yet another embodiment is shown in FIGS. 27-28. Fixedly secured with a control cord 1220 is a plurality of braces 1218. Brace 1218 includes a peg 1222. Fastener module 1200 includes a buckle member, such as annular member 1202 having a hole 1205, which is configured to engage with peg 1222. Arm member 1206 is shown as a pair of connectors 1207 that connect with the buckle member 1204 and the clip member 1204. Alternatively, the arm member can be a single connector. Similar to the fastener module of FIGS. 25 and 26, arm 1206 provides one degree of freedom of movement. Also similar to the previous embodiment, the arm member 1206 defines a vertical spacing between annular member 1202 and the clip member 1204. The vertical spacing defined by either of the connectors 1207 is greater than the width of the connector 1207.

Figure 30:
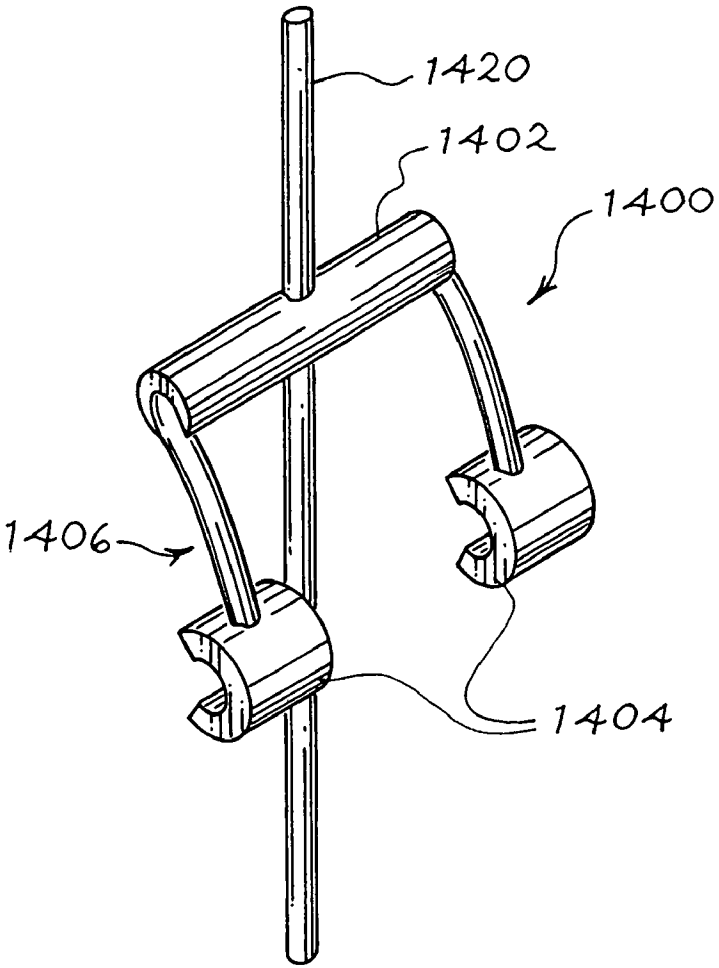
FIG. 30 is an enlarged perspective view of another alternative fastener module having an arm member and fixed secured with the control cord.
Figure 29:
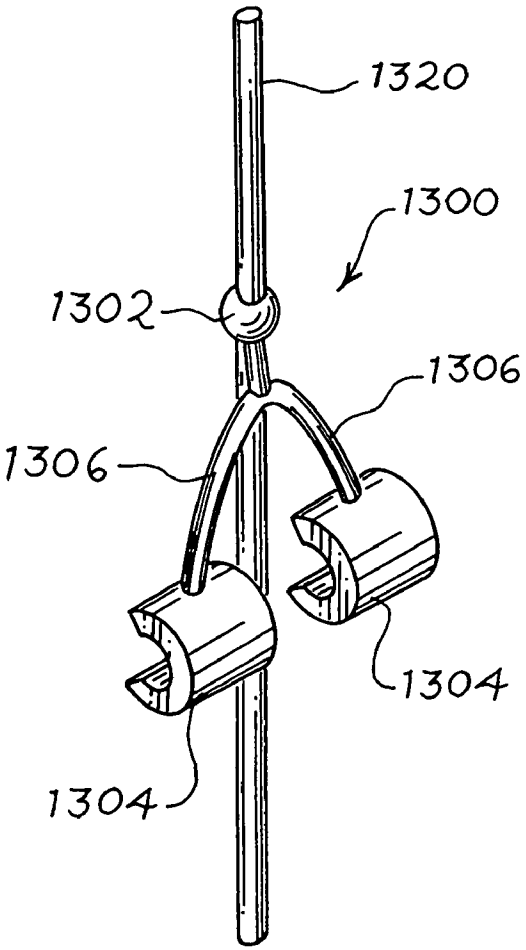
FIG. 29 is an enlarged perspective view of an alternative fastener module having an arm member and fixed secured with the control cord.

Fastener modules having an arm member may also fixedly secured with the control cord. Two embodiments of such fastener modules are shown in FIGS. 29 and 30. In FIG. 29, fastener module 1300 is fixedly secured with control cord 1320. In particular, buckle member 1302 is fixedly secured with control cord 1320 and a pair of clip members 1304 are connected therewith by a forked arm member 1306.In FIG. 30, fastener module 1400 is fixedly secured with control cord 1420 by buckle member 1402, which is connected to a pair of clip member 1404 by arm member 1406.

In the embodiments described, only a portion of one side of a row is shown. It should be understood that it is preferred that like control members and fastener modules be positioned on either side of the window covering as is well understood in the art to provide a balanced configuration.

The foregoing descriptions are taken as illustrative, but not limiting. Still other variants within the spirit and scope of the present invention will readily present themselves to those skilled in the art.

What is claimed is:

1. A window covering comprising:

a control member;

at least one anchor member positioned about a longitudinal portion of the window covering; and a fastener module connected to the control member and the anchor member, the fastener module of the window covering comprising:

a clip member secured with the anchor member;

a buckle member secured with the control member; and an elongate arm member extending from the buckle member and connecting to the clip member, wherein the arm member defines a vertical spacing between the buckle member and the clip member, the vertical spacing being greater than a width of the arm member.

2. The window covering of claim 1, wherein the control member includes a plurality of spaced braces, the braces adapted for securement with the buckle member.

3. The window covering of claim 2, wherein each of the braces defines a passageway and the buckle member includes an engagement member, whereby the engagement member is secured with one of the braces by positioning the engagement member within the passageway.

4. The window covering of claim 2, wherein each of the braces defines a peg, and the buckle member includes an annular portion having a hole through which the peg inserts to secure the control member with the buckle member.

5. The window covering of claim 1, wherein the buckle member is detachably securable with the control member.

6. The window covering of claim 1, wherein the buckle member is fixed with the control member.

7. The window covering of claim 1,wherein the clip member, the buckle member and the arm member are unitary with one another.

8. The window covering of claim 1, wherein the arm member provides a movement tolerance of the clip member relative to the buckle member.

9. The window covering of claim 1, wherein the clip member is detachably securable with the anchor member.

10. The window covering of claim 1, wherein the arm member is detachably securable with the anchor member.

11. The window covering of claim 1, wherein the arm member provides a movement tolerance of the anchor member relative to the buckle member.

12. A window covering comprising:

a fastener module;

a control member;

an anchor member positioned about a longitudinal portion of the window covering;

the fastener module comprising:

a buckle member secured with the control member; and an elongate clip member comprising a resilient band and securing the buckle member to the anchor member, the clip member extending from the buckle member and elongated to a detent, the detent being detachably securable with the buckle member, wherein the resilient band defines a vertical spacing between the buckle member and the anchor member, the vertical spacing being greater than a width of the resilient band.

13. The window covering of claim 12, wherein the buckle member includes an engagement opening and the detent of the clip member is securable with the engagement opening thereby forming a closed loop for securing with the anchor member.

14. The window covering of claim 12, wherein the clip member forms a loop around the anchor member.

15. The window covering of claim 12, wherein the buckle member is detachably securable with the control member.

16. The window covering of claim 12, wherein the buckle member is fixed with the control member.

17. A window covering comprising:

a control member;

an anchor member operatively connected to the control member by a fastener module, the anchor member positioned about a longitudinal portion of the window covering;

the fastener module comprising:

a clip member detachably secured to the anchor member;

a buckle member including an engagement opening and detachably secured to the control member; and an elongate arm member comprising a flexible band extending from the buckle member and connecting to the clip member, wherein the arm member defines a vertical spacing between the buckle member and the clip member, the vertical spacing being greater than a width of the arm member.

18. The window covering of claim 17, wherein the buckle member includes an engagement opening and the arm member terminates in a tip end securable with the engagement opening to form a closed loop for securing with the anchor member.

19. The window covering of claim 17, wherein the arm member forms a loop around the anchor member.

20. The window covering of claim 17, wherein the buckle member is detachably securable with the control member.

21. The window covering of claim 17, wherein the buckle member is fixed with the control member.

22. A window covering comprising:

a control member;

an anchor member positioned about a longitudinal portion of the window covering; and a fastener module comprising a buckle member detachably secured with the control member, and an elongate rigid arm member extending from the buckle member and connecting with the anchor member, the arm member extending from the buckle member and elongated to a clip member, wherein the arm member defines a vertical spacing between the buckle member and the anchor member, the vertical spacing being greater than a width of the arm member.

23. The window covering of claim 22, wherein the control member includes a plurality of spaced braces, the braces adapted for securement with the buckle member.

24. The window covering of claim 23, wherein each of the braces defines a passageway and the buckle member includes an engagement member, whereby the engagement member is secured with one of the braces by positioning the engagement member within the passageway.

25. The window covering of claim 24, wherein each of the braces defines a peg, and the buckle member includes an annular portion having a hole through which the peg inserts to secure the control member with the buckle member.

26. The window covering of claim 22, wherein the buckle member is detachably securable with the control member.

27. The window covering of claim 22, wherein the buckle member is fixed with the control member.

28. The window covering of claim 22, wherein the clip member, the buckle member and the arm member are unitary with one another.

29. The window covering of claim 22, wherein the arm member provides a movement tolerance of the clip member relative to the buckle member.

30. The window covering of claim 22, wherein the arm member provides a movement tolerance of the anchor member relative to the buckle member.

* * * * *

UNITED STATES PATENT AND TRADEMARK OFFICE

CERTIFICATE OF CORRECTION

PATENT NO. : 7,506,679 B2
APPLICATION NO. : 11/099324
DATED : March 24, 2009
INVENTOR(S) : Fu-Lai Yu et al.

It is certified that error appears in the above-identified patent and that said Letters Patent is hereby corrected as shown below:

SPECIFICATION

Column 4, line 15, insert --be-- between “can” and “inter-”

Column 5, line 14, delete “,” and insert --;--

Column 9, line 45, insert --.-- after “herself”

Signed and Sealed this

Twenty-eighth Day of July, 2009

John Doll

JOHN DOLL
*Acting Director of the United States Patent and Trademark Office*